United States Patent [19]

Mizelle

[11] Patent Number: 4,470,584

[45] Date of Patent: Sep. 11, 1984

[54] BOX SPRING ASSEMBLY

[75] Inventor: Ned W. Mizelle, High Point, N.C.

[73] Assignee: Hoover Universal, Inc., Ann Arbor, Mich.

[21] Appl. No.: 344,113

[22] Filed: Jan. 29, 1982

[51] Int. Cl.[3] ..... A47C 23/02; F16F 3/02

[52] U.S. Cl. ..... 267/103; 5/247; 5/255; 5/270; 5/476; 267/90

[58] Field of Search ..... 267/90, 103, 105, 110, 267/111, 112, 154, 157, 104, 106, 107, 108, 109; 5/247, 255, 259 R, 260, 264 R, 267, 270, 275, 476

[56] References Cited

U.S. PATENT DOCUMENTS

| | | | |
|---|---|---|---|
| 110,854 | 1/1871 | Judson | 5/275 |
| 908,273 | 12/1908 | Karr | 5/267 |
| 1,325,874 | 12/1919 | Krakauer | 5/267 |
| 3,574,241 | 4/1971 | Slominski | 5/255 |
| 3,680,157 | 8/1972 | Slominski et al. | 5/247 |
| 3,852,838 | 12/1974 | Slominski et al. | 5/247 |
| 4,060,862 | 12/1977 | Kitchen et al. | 5/260 |
| 4,186,223 | 1/1980 | Hancock | 5/247 |
| 4,218,790 | 8/1980 | Mizelle | 5/247 |
| 4,251,892 | 2/1981 | Hancock | 5/476 |
| 4,253,208 | 3/1981 | Hancock et al. | 5/247 |
| 4,339,834 | 7/1982 | Mizelle | 5/255 |

FOREIGN PATENT DOCUMENTS

| | | | |
|---|---|---|---|
| 5026/26 | 12/1926 | Australia | 5/264 R |

*Primary Examiner*—Douglas C. Butler
*Assistant Examiner*—R. R. Diefendorf
*Attorney, Agent, or Firm*—Stephenson and Boller

[57] ABSTRACT

A box spring assembly which includes a generally rectangular frame, a welded wire grid disposed above and aligned with the frame, a plurality of upwardly extending limited deflection wire springs which are mounted at their lower ends on the frame and at their upper ends are secured to the welded wire grid, and corner springs which are yieldable and are supported on the corners of the frame so as to support the corners of the grid. Each of the limited deflection springs is formed at its upper end with an attaching portion that is readily secured to the grid by conventional clips and includes wire sections which provide additional spaced supports for the grid. Improved cross rails in the frame support the springs and improved corner springs support the corners of the grid.

11 Claims, 9 Drawing Figures

BOX SPRING ASSEMBLY

BACKGROUND OF THE INVENTION

This invention relates generally to mattress foundation structures and more particularly to a box spring assembly of a type which utilizes non-coil springs. Box spring assemblies of this general type have been known since 1964, the first such spring assembly being disclosed in U.S. Pat. No. 3,286,281. Subsequently issued patents disclosing the same general type of box spring assembly are: U.S. Pat. Nos. 3,487,480; 3,506,987; 3,574,240; 3,574,241; 3,665,529; 3,680,157; 3,755,833; 3,824,639; 3,852,838; 4,060,862; 4,120,058; 4,131,961; 4,195,376; 4,218,790; 4,238,861; 4,251,892; and 4,253,208. Box spring assemblies of the general type shown in the above list of patents, all of which are assigned to the assignee of this application, are advantageous with respect to the conventional box spring assemblies using coil springs because they provide a desired stiffer foundation for the mattress and contain a reduced amount of wire. These box spring assemblies are also advantageous from the standpoints of prolonged service life, ease of assembly, and cost of manufacture.

Additional box spring assemblies of this general type are shown in U.S. Pat. Nos. 3,546,723; 3,596,299; 3,722,013; 3,825,960; 3,833,948; 3,835,485; 3,869,740; 3,990,121; and 4,000,531.

The present invention provides a box spring assembly which utilizes a wire deck or grid and a supporting spring that is different from the formed wire springs utilized in the patented box spring assemblies discussed above. The spring in the present box spring assembly is improved from the standpoint of providing desired qualities of firmness, internal strength, and edge support to the wire deck in addition to being readily connectible to the deck by conventional wrap-around clips. The improved box spring assembly of this invention also includes improved corner springs for supporting the corners of the deck on the frame and improved cross rails which support the springs on the frame.

SUMMARY OF THE INVENTION

The box spring assembly of this invention consists of a rectangular frame having side rails, end rails, and a plurality of cross rails that are generally parallel to each other and to the end rails and are substantially perpendicular to the side rails. The box spring assembly also includes a rectangular welded wire grid that forms a mattress support deck positioned above the frame and a plurality of limited deflection wire springs that are mounted on the cross rails and connected to the deck so as to yieldably resist downardly directed bedding loads.

Each of the springs is formed of spring steel wire and includes a pair of generally upright column portions which are connected at their lower ends to torsion bar supported feet that are mounted on the cross rails so that the columns can yieldably move downwardly under load toward the cross rails. When the springs are fully deflected, the column portions engage the cross rails to thereby limit spring deflection. At their upper ends, the columns are connected to deck attaching portions, each attaching portion being in the generally horizontal plane of the deck and extending between the upper ends of the columns. Each attaching portion includes an intermediate straight wire section arranged in a side-by-side supporting relation with a section of one of the straight wires in the deck. This section of the deck, as well as adjacent areas of the deck, are coated with a yieldable plastic material, and metal clips are applied to the side-by-side straight wire sections so as to firmly connect the deck to the supporting spring. By coating the portion of the deck on which the clips are mounted, the clips are able to secure the spring more tightly to the deck since the plastic coating has a substantial amount of "give" and allows the clips to bite into the wire coating. Also, the plastic coating increases the friction between the clips and the wire. As a result, the clips will not slip and the springs and the deck will remain in their intended relative positions. Coating of the deck portions which engage the supporting springs also eliminates undesirable noise caused by relative movement of wires that touch.

The deck attaching portion also includes a pair of straight connecting wire sections which are on opposite sides of the intermediate straight wire section, are substantially parallel to the intermediate section and are spaced substantially equal distances from the intermediate section. These straight connecting sections also provide yieldable support for spaced portions of a deck wire that is perpendicular to and intersects the deck wire that is clipped to the intermediate straight wire section.

The result is a formed wire box spring that is improved from the standpoint of firmness and internal strength because of the construction of the deck supporting springs and the manner in which these springs are assembled with the deck. Furthermore, by virtue of the construction of the springs with the straight connecting sections on opposite sides of the intermediate section, the springs can be located fairly close to the edges of the deck, thus providing the deck with firm edge support, a desirable characteristic in a mattress support. Also the spring attaching portions supplement the grid wires in forming the deck.

Improved cross rails facilitate assembly of the box spring and add to the internal strength of the assembly. Improved corner springs simplify the assembly and provide firm corner support for the deck.

Further objects, features, and advantages of this invention will become apparent from a consideration of the following description, the appended claims, and the accompanying drawing in which:

Figure 1:
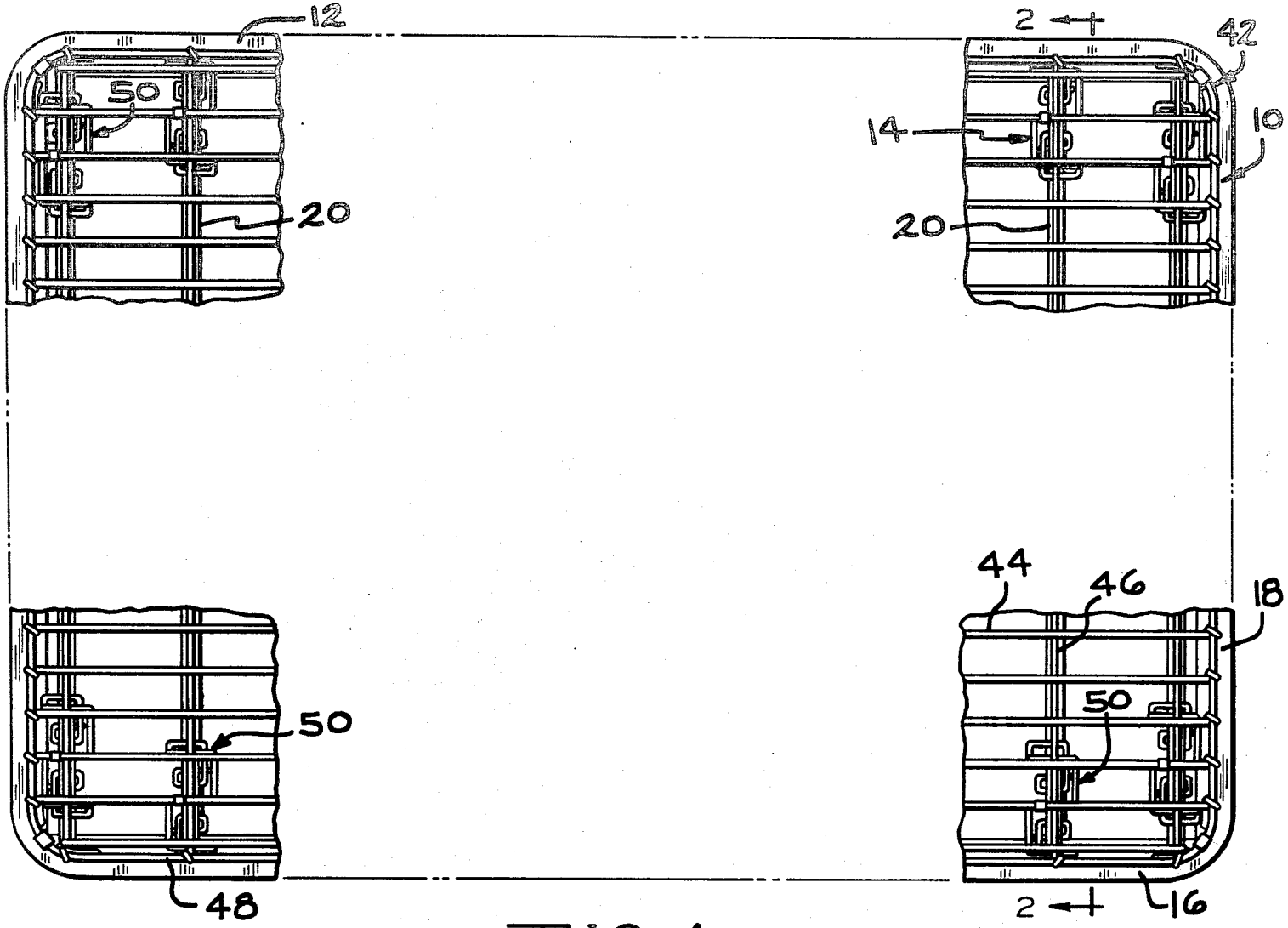
FIG. 1 is a plan view of the box spring assembly of this invention with the middle portion of the spring assembly being broken away for ease of illustration.

With reference to the drawing, the box spring assembly of this invention, indicated generally at 10, is illustrated in FIG. 1 as consisting of a generally rectangular, horizontally disposed frame 12, and a wire spring assemblage 14 mounted on the top side of the frame 12. The frame 12 has wooden side rails 16 and end rails 18 and metal cross rails 20 which are secured to and extend between the side rails 16.

Figure 2:
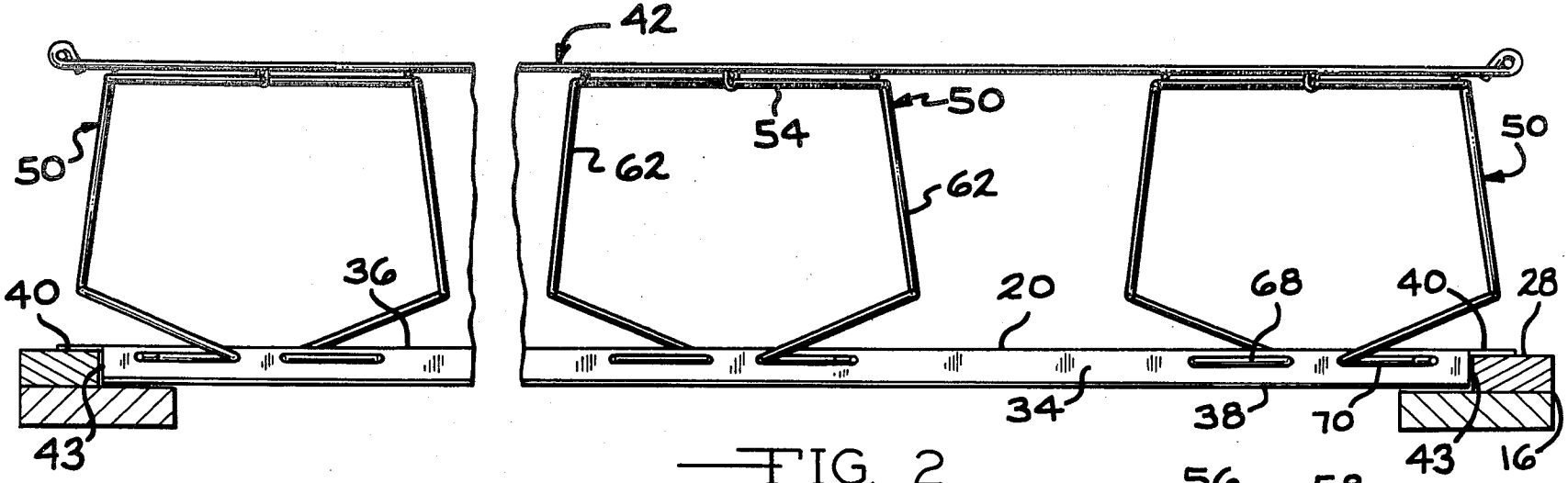
FIG. 2 is a foreshortened, enlarged, fragmentary detail sectional view of a portion of the box spring assembly of this invention as viewed from substantially the line 2—2 in FIG. 1.
Figure 4:
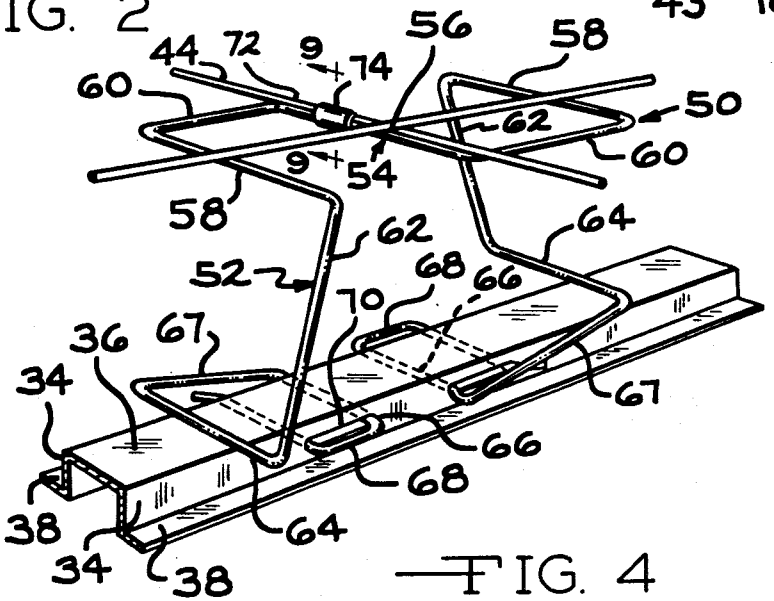
FIG. 4 is a fragmentary perspective view of one of the deck support springs in the box spring assembly of this invention, showing the spring supported at its lower end on a cross rail and in supporting relation at its upper end with the box spring grid or deck.
Figure 3:
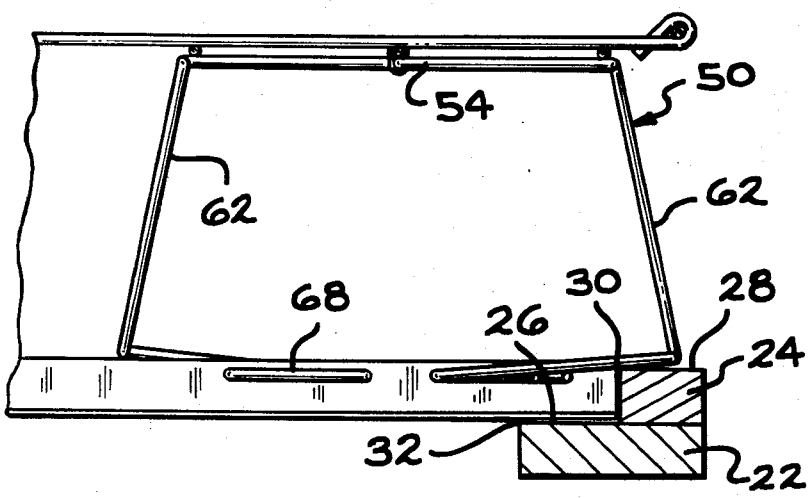
FIG. 3 is an enlarged sectional view, like FIG. 2, showing a deck support spring in a fully deflected position.

As best appears in FIGS. 2, 3 and 4, each of the side rails 16 consists of a lower member 22 and an upper member 24 which is smaller than the lower member 22 and is supported on the top surface 26 thereof. The top member 24, which has a top surface 28, is spaced outwardly at its inner edge 30 from the inner edge 32 of the lower member 22, for a purpose to appear presently. Each cross rail 20 is of a special shape, and includes a pair of upright webs 34 which are spaced apart and connected at their upper edges by a top plate 36. At their lower edges, the webs 34 are provided with oppositely extending flat flanges 38. As shown in FIG. 2, extensions 40 of the top plate 36 extend beyond the ends 43 of the rail 20. As a result, when the rails 20 are supported on the side rails 16, the flat flanges 38 rest on the top surface 26 of the lower member 22 and the plate extensions 40 rest on the top surface 28 of the upper member 24. This enables the cross rails 20 to be firmly secured to the side rails 16 by extending staples, nails, or the like (not shown) through either or both the flanges 38 and the extensions 40 into the side rails 16.

The spring assemblage 14 includes a horizontally disposed welded wire grid or deck 42 which consists of a plurality of straight wires that are arranged in criss-cross fashion, some of the wires extending lengthwise of the frame 12, referred to hereinafter as "lengthwise wires" 44 and some of the wires extending crosswise of the frame 12, hereinafter referred to as "crosswise wires 46". The wire grid 42 also includes a rectangular border wire 48 which is secured to the ends of the wires 44 and 46 which are in turn welded together at their junctures. The border wire 48 is of substantially the same size and shape as frame 12.

Figure 8:
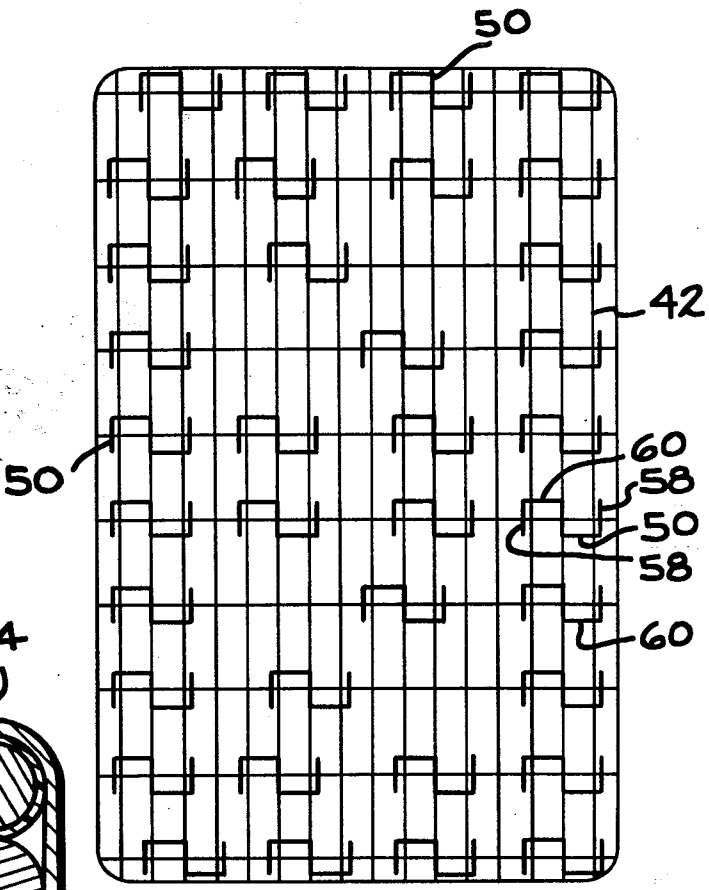
FIGS. 7 and 8 are diagrammatic views of box spring assemblies of this invention illustrating different arrangements of the supporting springs on the frame to support the grid.
Figure 9:
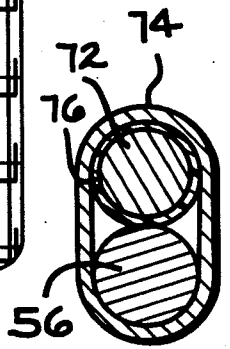
FIG. 9 is an enlarged sectional view illustrating the assembly of a connecting clip with a spring wire and a deck wire, as seen from substantially the line 9—9 in FIG. 4.
Figure 7:
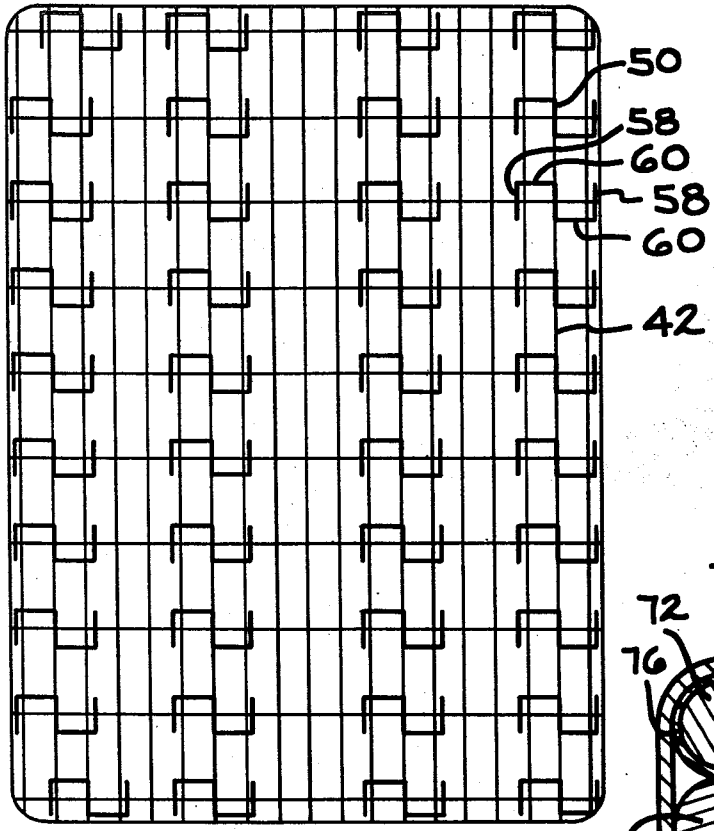

The welded wire grid 42 forms a mattress support deck disposed in a horizontal plane at a predetermined distance above the frame 12. A plurality of limited deflection support springs 50, arranged in a predetermined pattern on frame 12, which pattern can vary depending upon the size of the spring assembly 10 and other manufacturing and support characteristic considerations, as illustrated in FIGS. 7 and 8, yieldably support the grid 42 in this position above the frame 12 for yieldable movement toward the frame to accommodate bedding loads, namely, the mattress and the mattress occupants.

As best appears in FIGS. 2, 3 and 4, each of the springs 50, which is formed of spring wire, consists of an upright yieldable portion 52 formed integral at its upper end with an attaching portion 54 and secured at its lower end to one of the frame crossrails 20.

The attaching portion 54 consists of an intermediate straight wire section 56 and a pair of straight connecting wire sections 58 which are disposed on opposite sides of the section 56 in a spaced relation with the section 56 and in positions generally parallel to each other and to the straight section 56. The connecting sections 58 are joined to opposite ends of the intermediate section 56 by cross wire sections 60. The yieldable portion 52 consists of a pair of upright columns 62 formed integral at their upper ends with the connecting wire sections 58. At their lower ends, the columns 62 are formed integral with transversely extending torsion bars 64 that are substantially parallel to and are disposed directly below and outwardly of the connecting sections 58 so that the columns 62 diverge in a downward direction, as shown in FIG. 2.

Torsion bars 66 at the lower end of the yieldable portion 52 form part of foot sections 68 which extend through and are retained in slots 70 formed in the webs 34 in the cross rail 20. This type of spring mounting is described in detail in U.S. Pat. No. 3,680,157, assigned to the assignee of this application. Inclined bars 67 connect the bars 64 and 66.

Each straight wire section 56 is arranged in a side-by-side relation with a section 72 of straight wire in the grid 42, as shown in FIG. 4. The side-by-side straight wire sections 56 and 72 are then secured together by wrap-around clips, of conventional type, indicated at 74. It is to be noted that in the illustrated forms of the invention, the spring attaching portions 56 are all attached to lengthwise wires 44 in grid 42. In such an embodiment, at least the sections 72 of the wires 44 that are clipped to the springs 50 are provided with a coating 76 of a yieldable plastic material prior to application of the clips 74, as disclosed in U.S. Pat. No. 4,186,223, also assigned to the assignee of this application. The plastic coating can be a vinyl coating or it can be a polyurethane coating or can be some other soft plastic coating that will facilitate the application of the clips 74 to the springs 50 and the wire grid 42.

Alternatively, the attaching portions 54 of the springs 50 can be provided with the coating 76 or the entire grid 42 can be coated. Preferably, the areas of the grid 42 which engage the springs 50 are coated. This not only facilitates application of the clips 74 but also eliminates noise caused by relative movement of the grid 42 and the springs 50 which occurs when the assembly 10 is loaded and unloaded.

Figure 5:
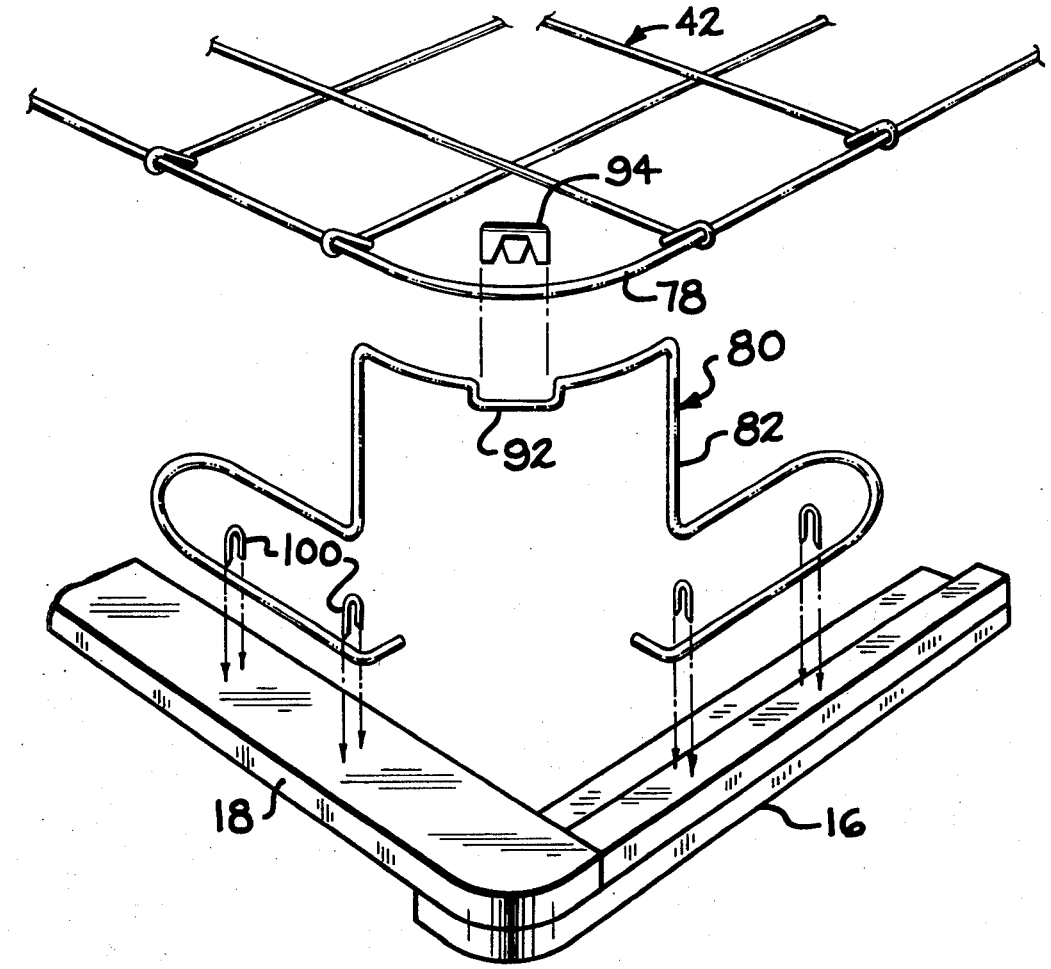
FIG. 5 is an exploded perspective view of one corner of the box spring assembly of this invention.
Figure 6:
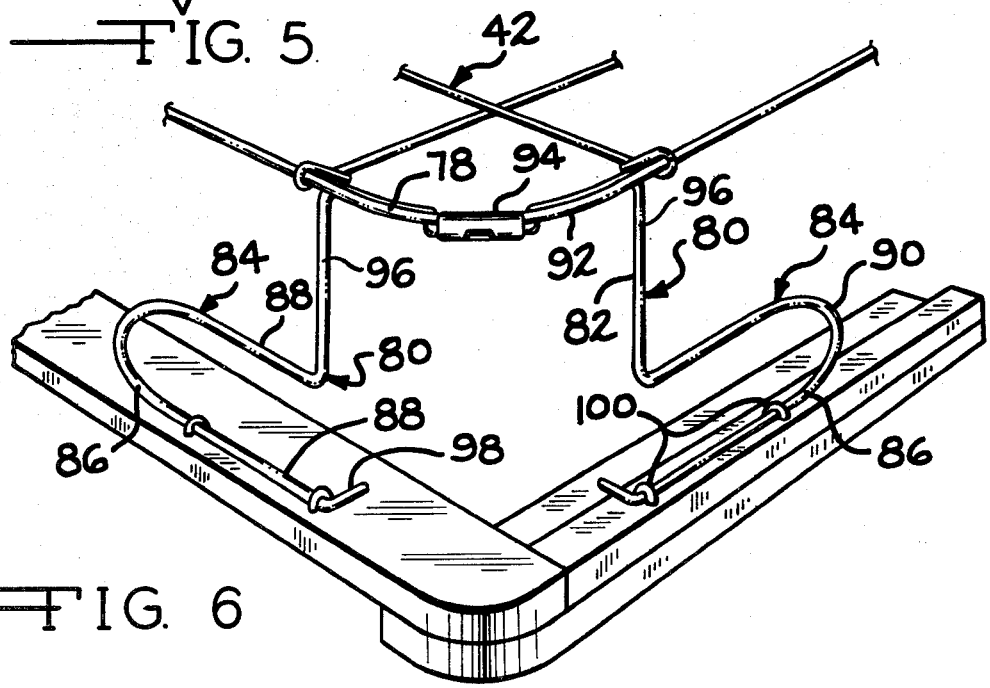
FIG. 6 is a perspective view of a corner spring in the box spring assembly of this invention, showing the spring in assembly relation with the supporting frame and the box spring deck.

As shown in FIGS. 5 and 6, the border wire 48 in the welded wire grid 42, has curved corner portions 78. These portions are yieldably supported on the frame 12 by corner springs 80. Each spring 80 consists of a wire body 82 that is bent to form a pair of leg portions 84 that are disposed at substantially right angles relative to each other. Each leg portion 84 consists of a return bent-upon-itself wire section 86 having vertically spaced lengths 88 joined by a curved connector 90. The corner spring 80 has a curved section 92 at its upper end which is horizontal and is movable into a side-by-side relation with the curved corner 78 of the grid 42 so that it can be secured thereto by a wrap-around clip 94. Upright columns 96 at the ends of the curved section 92 connect the section 92 to the leg sections 84 which are stabilized in upright planes on the frame 12 by right angle feet 98 that engaged the frame 12. Each corner spring 80 is mounted on the frame by extending staples 100 across the lower lengths 88 of each of the sections 86 and into the frame 12.

In the assembly of the box spring assembly 10, the support springs 50 are mounted in the slots 70 in the cross rails 20 and the corner springs 80 are secured to the corners of the frame 12 as shown in FIG. 6. The welded wire grid 42 is then placed on the springs 50 and 80 and secured thereto by the clips 74 and 94. The entire frame, grid and spring assembly is then covered with a conventional padding or similar material followed by the application of the usual fabric.

It is pointed out that the support springs 50 are relatively small in plan view relative to the size of the grid 42. This enables the arrangement of the springs 50 in a variety of patterns below the grid 42 to yieldably support the grid according to a variety of manufacturing and user considerations. This is illustrated in FIGS. 7 and 8 which show that the pattern of the springs 50 can be either regular (FIG. 7) or irregular (FIG. 8).

It is also advantageous to form various wire parts in the assembly 10 of different gauge wire. For example, in a preferred embodiment, the springs 50 and 80 are formed of 8½ gauge wire, the cross wires 46 are of 9 gauge wire and the long wires 44 are of 13 gauge wire. This use of smaller diameter wire where possible reduces the overall weight of the assembly 10.

In the use of the box spring assembly 10, the springs 50 and 80 will yield in a vertical directions to accommodate bedding loads and provide the occupant of a mattress supported on the grid 42 with the desired feel that is associated with comfort. Both the springs 50 and the springs 80 include upright columns which will bottom out on the frame to limit deflection of the springs in the event of overloading of the springs. The springs 50 can be located relatively close to the borders of the assembly 10 so as to provide the assembly with the desired edge strength. In addition, because the springs 50 include the columns 52 and only two torsion bars 64 and 66 for each column, the springs 50 are very firm. The springs 50 thus impart a desired feeling of firm support to an occupant of a mattress supported on the deck 42 and provide great internal strength to the entire assembly 10. Because the springs 50 and 80 are limited deflection springs, it is difficult to stress the springs 50 during use of the assembly 10 to the point where they would take a "set", thus providing the assembly 10 with a long service life. As shown in FIGS. 7 and 8, the attaching portions of the springs 50 also supplement the grid wires 44 and 46 in forming the supporting deck for the mattress, by virtue of the spacing of the spring wire sections 58 and 60 between the grid wires 44 and 46.

What is claimed is:

1. In a box spring assembly which includes a generally horizontal rectangular frame having corners and a generally horizontal wire mattress support deck disposed a predetermined distance above said frame, said deck including a plurality of substantially straight wires arranged in a criss-cross fashion, some of said wires extending lengthwise of said frame and others of said wires extending crosswise of said frame and a border wire having corner portions located above and substantially vertically aligned with the corners of said frame; a plurality of deck support springs arranged between said deck and said frame so as to yieldably support said deck on said frame, at least one of said springs including vertically yieldable portions mounted at their lower ends on said frame and terminating at their upper ends in upwardly extending portions and a deck-attaching portion at the upper ends of said vertically yieldable portions, said deck attaching portion comprising an intermediate straight wire section arranged in a side-by-side supporting relation with a section of one of said deck straight wires, clip means connecting said straight wire sections, said deck attaching portion further comprising connecting wire sections formed integral with the ends of said striaght wire section and the upper ends of said upwardly extending vertically yieldable portions, said connecting wire sections including substantially straight portions that are generally parallel to and spaced on opposite sides of said intermediate straight wire section and being arranged in a supporting relation with spaced portions of another one of said deck wires that is generally perpendicular to said one deck wire.

2. The box spring assembly according to claim 1 wherein said crosswise and lengthwise wires are straight from end to end.

3. The box spring assembly according to claim 2 further including corner springs supported on and projecting upwardly from said frame corners, each said corner spring comprising a single piece of wire bent to form a pair of spaced supporting feet secured to said frame and arranged at substantially right angles relative to each other, each of said feet being vertically yieldable and a connecting member secured to said feet and to said deck.

4. A box spring assembly comprising a rectangular frame having side rails, end rails, and a plurality of cross rails that are generally parallel to each other and are substantially perpendicular to said side rails, means forming a deck consisting of a rectangular border wire positioned above and in substantial alignment with said frame, a plurality of substantially straight wires arranged criss-cross fashion within said border wire and secured to each other and to said border wire, some of said wires extending crosswise of said frame at positions directly above said cross rails and others of said wires extending lengthwise of said frame across said crosswise wires, a plurality of wire springs mounted on said cross rails and connected to said deck so as to yieldably resist downwardly directed bedding loads applied to the deck, each of said springs including a vertically yieldable portion mounted at the lower end on one of said crossrails and terminating at the upper end in a deck attaching and supporting portion, each said deck attaching and supporting portion including an intermediate straight wire section and a pair of generally parallel straight connecting wire sections which are spaced from and arranged on opposite sides of said intermeidate section, each said attaching and supporting portion being located so that said intermediate straight wire section is in a side-by-side relation with a section of one of said deck straight wires and said straight connecting sections are on opposite sides of said intermediate section at positions in between pairs of adjacent deck wires parallel to said one deck wire and below and in a supporting relation with spaced portions of still another one of said straight deck wires that is perpendicular to said one straight deck wire.

5. The box spring assembly according to claim 4 wherein said cross rails are formed so that each has a pair of upright horizontally spaced webs joined at their upper edges by a top plate and formed integral at their lower edges with oppositely directed flat flanges supported on said side rails, and coacting means on said webs and said spring lower ends providing for mounting of said lower ends at predetermined locations on said webs.

6. The box spring assembly according to claim 5 wherein each of said side rails consists of a lower member having a top surface with an inner edge and an upper member mounted on said top surface at a position spaced outwardly from said inner edge, said upper member having a top surface spaced above said lower member top surface a distance substantially equal to the distance between said cross rail top plate and flat flanges, the flat flanges at the ends of said cross rails being supported on said lower member top surfaces and extensions on the ends of said top plate supported on said upper member top surfaces.

7. A limited deflection spring comprising a wire body having an upright yieldabtle portion, an attaching portion at the upper end of said upright portion, and at least one mounting foot at the lower end of said upright portion, said attaching portion being substantially horizontal and including an intermediate straight wire section and a pair of generally parallel straight spaced wire sections spaced from and disposed on opposite sides of said intermediate section in a generally parallel relation with said intermediate wire section and a pair of connecting wire sections integral with and extending between the ends of said intermediate wire section and said parallel wire sections, said intermediate and parallel straight wire sections being substantially coplanar and of the same length, and said upright yieldable portion comprising a pair of downwardly extending diverging columns integral at their upper ends with said straight parallel wire sections, first torsion bars corresponding to and spaced below said columns, second torsion bars at the lower ends of said columns, said second torsion bars extending transversely of said columns and parallel to said first torsion bars, and downwardly inclined connecting bars corresponding to said columns and extending between the first and second torsion bars for each column.

8. The spring according to claim 7 wherein said torsion bars are generally parallel to said straight wire sections in said attaching portion.

9. The spring according to claim 8 further including generally horizontal mounting feet integral with said first torsion bars and located beneath said attaching portion, said feet being located in a spaced relation in which said inclined connecting bars are maintained in a spaced non-overlapped relation.

10. In a box spring assembly which includes a generally horizontal rectangular frame including side rails, end rails and cross rails extending between said side rails in positions generally parallel to said end rails and a plurality of grid support springs supported on said frame cross rails, each of said springs including vertically yieldable portions mounted at their lower ends on said frame and terminating at their upper ends in upwardly extending portions and a grid-attaching portion at the upper ends of said upwardly extending portions, each said grid attaching portion comprising an intermediate straight wire section and connecting wire sections formed integral with the ends of said straight wire section and the upper ends of said upwardly extending vertically yieldable portions, a welded wire grid unit supported on said springs, said grid comprising a plurality of grid wires arranged criss-cross fashion including longitudinal wires extending lengthwise of said frame and transverse wires extending crosswise of said frame and a generally rectangular border member forming a boundary for said grid wires and located above and in substantially vertical alignment with said frame; said border member including side portions disposed directly above said frame side rails, some of said longitudinal grid wires having substantially straight sections and being arranged side-by-side with said straight wire spring sections, clip means connecting said side-by-side straight wire sections, said connecting wire sections in said grid attaching portions being arranged in a supporting relation with spaced portions of some said transverse grid wires, some of said springs being located on said cross rails at positions such that said connecting wire sections on said springs are in a supporting relation with said transverse grid wires at positions adjacent said border member side portions to thereby provide added support for said border member side portions, said grid wires being welded to each other at the intersections thereof and being attached at the ends thereof to said border member.

11. The box spring assembly according to claim 10 wherein said connecting wire sections include straight portions that are generally parallel to and spaced on opposite sides of said intermediate straight wire section.

* * * * *